United States Patent [19]

Paluchniak et al.

[11] 3,951,200

[45] Apr. 20, 1976

[54] VAPOR CASTING METHOD AND APPARATUS

[75] Inventors: Michael J. Paluchniak; John T. Cummings, both of Downers Grove, Ill.

[73] Assignee: Industrial Machinery Engineering Corporation, Highland Park, Ill.

[22] Filed: Mar. 6, 1975

[21] Appl. No.: 555,861

[52] U.S. Cl. ..... 164/119; 164/285

[51] Int. Cl.[2] ..... B22D 17/00; B22D 27/14

[58] Field of Search ..... 164/113, 119, 285, 48

[56] References Cited

UNITED STATES PATENTS

| | | | |
|---|---|---|---|
| 1,313,602 | 8/1919 | Luxmore | 164/119 X |
| 1,961,941 | 6/1934 | Pack | 164/113 |
| 2,476,296 | 7/1949 | Hardy | 164/285 |
| 2,568,428 | 9/1951 | Billiar | 164/285 |

FOREIGN PATENTS OR APPLICATIONS

| | | | |
|---|---|---|---|
| 595,795 | 12/1947 | United Kingdom | 164/119 |

*Primary Examiner*—Robert D. Baldwin

*Attorney, Agent, or Firm*—Silverman & Cass, Ltd.

[57] ABSTRACT

Method of and apparatus for die casting metal in which the die parts have a well for receiving the molten metal in a body preliminary to closing the die parts and gating channels lead from the well to the mold chambers. One of the die parts has means for injecting a pre-metered volume of water into the body of metal in the well so that after the die parts are closed together and the injecting means are operated to inject the water the rapid conversion of the water into steam and subsequent expansion produce sufficient force to cause the molten metal in the well to be forced into the mold chambers where it is chilled thereby forming the castings.

21 Claims, 6 Drawing Figures

VAPOR CASTING METHOD AND APPARATUS

BACKGROUND AND FIELD OF THE INVENTION

The invention herein is concerned with the die casting of metal in which molten metal is forced into metallic molds under pressure. Conventionally such pressure is provided by hydraulic means effected by utilizing a mechanically actuated piston or ram acting on the molten metal itself.

The invention herein does not use hydraulic pressure but instead utilizes the pressure produced by steam or other vapor preferably generated within the molding die itself in a manner to be described.

In the present state of the technology of die casting the apparatus utilized for forcing the molten metal into the molds includes a hydraulic ram. The ancillary apparatus needed for operating the ram includes pumps, cylinders and associated equipment. In a so-called die casting machine, all of the apparatus is included making the device large and costly.

Hydraulically operated die casting machines are subject to disadvantages most of which are traceable directly to the method of forcing the molten metal into the molds. These disadvantages are inordinate die wear, excessive flash in the castings, need for robust dies and inability to make delicate and thin-walled castings. Probably the principal reason for these disadvantages is that the plunger type injection system requires a fast-moving ram which tends to blow the die open and stress the same.

The advantages of the vapor cast method and apparatus which will be described point out other areas of the conventional system which are not desirable but have been tolerated because they are inherent in the use of the plunger type injection system.

Besides the elimination of all of the hydraulic mechanisms, vapor casting apparatus can be made much smaller than the conventional injection type die casting machines for the same size of molds which results in considerable economy.

Die cooling systems are not as essential because in the vapor casting method the heat from the metal is absorbed in providing steam vapor energy.

The vapor casting apparatus is preferably arranged to be operated vertically thereby saving considerable floor space. Plunger type injection molding systems as used today are practically all horizontal.

Other mechanical advantages are related to simpler and more economical construction of the vapor casting machine.

The prior art which is known to the applicants and which relates to the use of applying pressure to molds in casting metal is generally concerned with attempting to compact the casting and eliminate blow holes by the use of water, steam or compressed air. Steam or compressed air has been used to cause the metal of a pot or ladle to flow through a conduit into a mold.

U.S. Pat. No. 8,427 issued to Jones shows the use of a mold in which there is a large ingot to be formed. The ingot mold is filled partway and then steam is admitted to the mold. Mention is also made of spraying water into the jacket of the mold. U.S. Pat. No. 464,441 issued to Rockman also teaches the use of compressed air or steam on castings to compress them.

In neither of these prior art patents is there an injection of a specific volume of water or other varporizable material into a body of molten metal within the die or adjacent to the die to produce steam or other vapor which forces the metal to flow from the well containing the body of molten metal through the gating channels and into the molding cavities themselves.

The next patent of the prior art which is of interest is U.S. Pat. No. 1,092,934 issued to Mellen in which there is a crucible that is maintained at high heat within a furnace and that is provided with an extrusion die in its bottom below the body of metal. Water, oil, etc., is admitted into the top of the crucible to expand and exert a constant gaseous pressure on the surface of the molten metal to force it through the die in the bottom of the crucible.

The prior art as known does not inject a metered quantity of water or other vaporizable material into the center of a body of molten metal that is contained in a well formed in or adjacent to a die set while the die set is in fully closed condition whereby the vapor generated continuously expands and forces the metal from the well into the mold cavities by way of the gating channels. The expanding steam or other vapor thus draws heat for its energy from the molten metal that surrounds it.

SUMMARY OF THE INVENTION

A method of die casting which utilizes a type of die having two parts containing the separate mold cavities or mold means so that when brought together they will form the complete molds. There is a well with gating channels leading to the cavities. There can be one cavity but normally there will be at least two so that plurality castings will be produced. The well is in the die or adjacent thereto.

According to the method, the well is charged with a predetermined volume of molten metal the amount of which is known will fill the cavities and leave sufficient to close the gating channels so that the castings will be complete. The excess, if any, will at most coat some of the remaining non-cavity portions of the hollow configurations of the die. The die parts are brought together and secured. A predetermined volume of vaporizable material such as de-ionized water is injected into the center of the molten metal in the well. The steam generated forces the molten liquid through the gating channels into the cavities where the chilling takes place while there is still steam pressure in the well. Thereafter the die parts are separated and the castings are ejected from the molds. Whatever metal may have adhered to the other portions of the die parts is also removed at this time, either by ejection pins or other mechanical means.

The apparatus of the invention, in addition to a mold which provides the well which has been referred to above, also contemplates means to enable the injection of the vaporizable material into the well below the surface of the body of molten metal that is contained therein. Preferably the mold itself has a projection which is included as a part of the upper half of the mold that enters into the well. The projection has a port at its bottom tip that is the discharge side of a valve that comprises the means for injecting the liquid into the body of molten metal. Means are provided for connecting (in this case) the upper die half with the liquid metering and valve actuating mechanism. The structure including the valve has water-cooled jacketing, preferably, so that the liquid will remain at nonvaporized condition until after it is injected.

A modified form of the invention has the well in structure apart from the die but connected thereto by suitable conduits. The projection is associated with such well.

DESCRIPTION OF THE PREFERRED EMBODIMENTS

Figure 1:
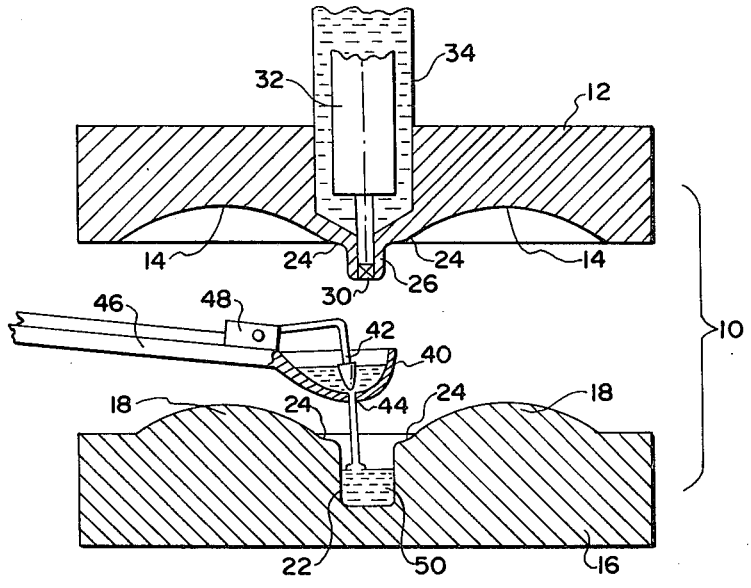
FIG. 1 is a generally diagrammatic sectional view taken through a die set whose halves are separated and showing, in addition to some of the apparatus of the invention, the manner in which the first step of the method is effected.

As stated above the invention is concerned with die casting as opposed to casting of parts in sand molds or ingots. In die casting as practiced heretofore, the parts are normally smaller and more delicate than those which are cast by molded sand processes or in large receptacles as ingots to be worked, the dimensions and configurations in die casting being more carefully controlled. The usual die casting machine has permanent metal molds of robust construction which may be cooled by suitable means, these being connected to one or more gating channels which lead to a chamber comprising part of a cylinder. There is a ram or piston in the cylinder which is adapted to be driven to decrease the volume of the cylinder quite substantially.

When it is desired to run metal into the cavities that are formed in the die set, the die set parts are brought together and locked in position, a charge of molten metal is run into the chamber and the ram is actuated with great force. The molten metal in the chamber is forced through the gating channels into the molds and the pressure is maintained by not retracting the ram.

When the castings have solidified, the ram is retracted. The die halves are now separated exposing the molded castings. These are then ejected or otherwise removed, the mold cavities cleaned of extraneous metal and the process repeated.

According to the invention, the force which is required for the movement of the molten metal into the cavities is provided by the heat energy of the molten metal itself. In this way there is substantial saving in apparatus comprising the hydraulic system, in energy and mechanisms required to operate the plunger, contain and channel the metal and there are savings in not being required to cool the castings because their heat is otherwise utilized.

The invention basically comprises a method in which a predetermined quantity of vaporizable liquid is injected into the charge of molten metal of the die and converted into steam or other vapor by the heat of the metal itself. This steam, expanding from the center of the well of molten metal, exerts the necessary pressure to force the metal into the mold cavities while extracting heat from the metal and chilling the castings as they solidify in the mold cavities.

It can be shown by suitable calculations that the amount of liquid or other material, such as for example — water, needed to create the necessary steam pressure for moving a given quantity of metal is very small. Using physical laws relating to the displacement of water, the volume of metal to be moved, the pressures generated when the water is converted into steam, etc., it can be shown that for the types of metals suitable for die casting the following amounts of water are required:

| | PD = 1,000 | PD = 10,000 | PD = 500,000 |
|---|---|---|---|
| Zinc | .02427 | .2427 | 12.135 |
| Magnesium | .0214 | .214 | 10.7 |
| Aluminum | .01892 | .1892 | 9.46 |
| Brass | .01387 | .1387 | 6.9345 |
| Cast Iron | .01166 | .1166 | 5.83 |
| Carbon Steel | .00965 | .0965 | 4.826 |

The volumes of water are in cubic inches at room temperature. The values P and D respectively represent the casting pressure of the particular metal in pounds per square inch and the molten metal displacement for a particular casting in cubic inches. As would be understood, the greater the volume of metal which is to be moved, the greater the amount of water needed to be injected, but the amount for the same volume of metal depends upon the metal itself. The physical characteristics of the casting metals used today are well known, so it is a simple matter to compute the amount of water to be injected. The casting pressure P and the volume of displacement D are design criteria for the particular die and depend on the kind of metal and the size of the castings.

Figure 2:
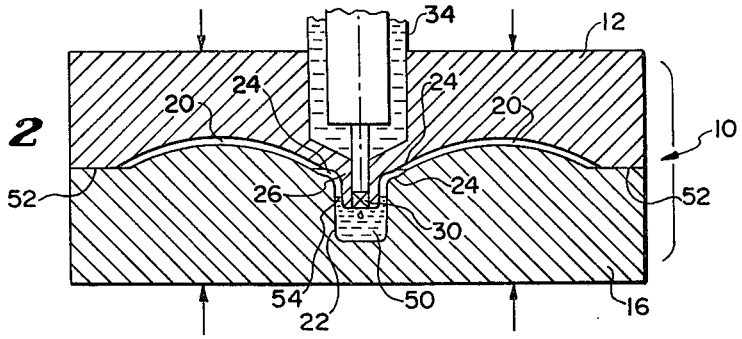
FIG. 2 is a similar view, but in this case the die halves have been brought together after the removal of the ladle, and the vaporizable liquid is in the process of being injected.

Referring now to FIGS. 1 and 2, there is illustrated a die set or die 10 which is constructed for use with the invention. The upper part or half 12 is provided with two cavities 14 that are formed on the underside of the die half 12 by any suitable method conventionally used to make dies. The lower part or half 16 of the die set is aligned with and intended to mate and match the upper half 12 when the two halves are brought together face to face. This is indicated by the pressure arrows shown on the outer surfaces of the die halves in FIG. 2. Suitable pilot pins and sockets of the usual construction would be used (as will be shown in FIG. 4) to assure perfect alignment when the die halves come together.

The lower half 16 has a protrusion 18 on its upper surface to match and combine with each of the cavities 14 and designed of such dimension and configuration to provide a fully enclosed mold when the die 10 is in its "closed" condition as in FIG. 2. In the structure illustrated there are two such molds so that two castings will be made for each cycle of operation of the apparatus. The particular articles represented by the castings intended to be made in the example illustrated and described are dish-like members which will be formed in the enclosed spaces 20.

The lower half 16 of the die set 10 has a central well 22 formed of a volume which takes into consideration the amount of metal needed to fill the spaces 20, the runners or gating channels 24 and such risers or overflow spaces (not shown) which may be a part of the die design. The gating channels 24 are formed only after the die halves 12 and 16 are brought together, this being effected by cutting the metal of the respective die halves in such a manner that certain grooves are formed and spaced apart to leave the channels 24. The technique is well known. The upper half 12 of the die set 10 has a central depending protrusion 26 which will be called an injector nose for reasons which will become apparent hereinafter. The injector nose 26 enters substantially downward into the well 22 when the die halves 12 and 16 are mated as will be evident from FIGS. 2, 3A, 3B and 3C.

When the injector nose 26 is in position within the well 22 as in FIG. 2, the gating channels 24 are formed from the grooves in the respective die halves and provide the only egress from the well 22. Molten metal forced out of the well 22 will be required to move around the injector nose 26 to the gating channels 24.

The upper die half 12 has a central normally closed valve 30 which is generally centered on the interior of the injector nose 26 and provides an opening or port 58 into the well from the bottom of the injector nose 26. A mechanism which is designated generally 32 is provided in connection with the valve 30 whose purpose it is to enable the valve 30 to be operated from the exterior of the die 10 so that the valve 30 can be opened as desired and a predetermind volume of water metered from the valve and thereafter the valve 30 can be closed. Such a mechanism 32 will be suitably cooled as by water jackets 34 so that the water which it injects into the well 22 by way of the port 58 will initially be liquid. Obviously, the apparatus 32 will include metering means, either directly at the die half or remote therefrom.

The operation of the apparatus is generally the filling of the well with molten metal, the closing of the die 10, the injection of the water (or other vaporizable liquid), the opening of the die and removal of the castings, the cleaning of the die if necessary and repeat.

In FIG. 1, the die 10 is open. A ladle 40, preferably with a remote-operated plunger 42 cooperating with a suitable pouring spout 44 is brought into position over the well 22 on a transport arm 46. The mechanism for raising the plunger 42 is generally indicated symbolically at 48 and this is operated through suitable control channels and timing devices (not shown) to pour a predetermined charge of molten metal 50 into the well. The ladle 40 is then removed from between the die halves and the two halves 12 and 16 are brought together and locked in their mating positions. The formed molds 20 are enclosed as is the well 22. The faces of the die halves are in tight engagement as shown at 52, the die being constructed in such a manner as to prevent escape of molten metal or gas from these joints.

When the die halves are brought together, the injector nose 26 enters into the body of molten metal 50 that is in the well 22 raising the level of the metal slightly to the point 54 where such metal is at the entrance to the gating channels 24. Actually there is nothing wrong with the metal rising well into the gating channels 24 except the practical aspect of preventing the molten metal from rising above the face 52 of the lower die half 16 and thereby contaminating the joint.

Assuming that the die set 10 is closed and locked, the injecting mechanism 32 is operated. A predetermined volume of vaporizable liquid such as for example deionized water is now injected into the center of the body of molten metal 50 in the well 22. This liquid is shown at 56 in FIG. 3A emerging from the opening or port 58 of the valve 30 and being forced downward. After the water has been injected the valve 30 closes the port and the water is fully contained within the metal 50. As soon as the water 56 enters the well 22 steam immediately starts to form as indicated at 60 and surrounds the water 56 but this condition obtains for only a short time since all of the water is quickly converted into steam as shown by the large steam bubble 62 in FIG. 3B. The steam draws heat from the metal 50 and expands rapidly and with great pressure. Consequently, the metal 50 of the well is forced into the gating channels 24 and thence into the mold cavities 20. The metal is cooler than normal die casting metal because it has already lost considerable heat in the making of the steam and hence will chill rapidly in the molds. The pressure moving the metal is not a hydrostatic pressure transmitted through the metal by a positively moving plunger or ram but is an expanding variable pressure that builds up. Accordingly, the die halves are not shocked and do not as readily tend to separate when all of the metal has been run into the cavities since the pressure is already diminishing by that time. Thus, the flash is less than in conventional die-casting.

Figure 3A:
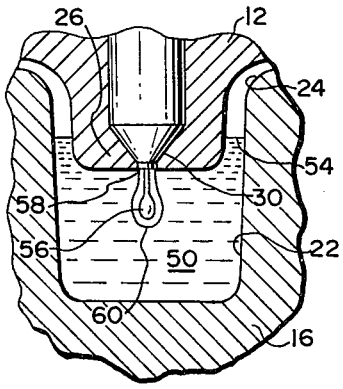
FIGS. 3A, 3B and 3C are fragmentary sectional views of a diagrammatic nature taken generally through the center of the die of FIGS. 1 and 2 and showing progressively three phases of the process which occurs after the injection of vaporizable liquid into the well.
Figure 3B:
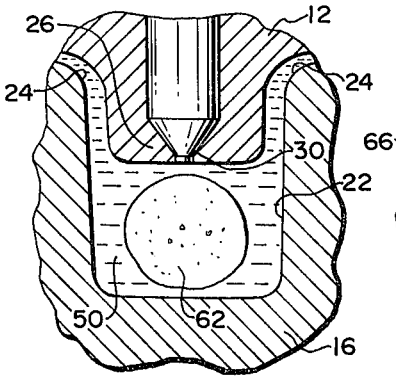
Figure 3C:
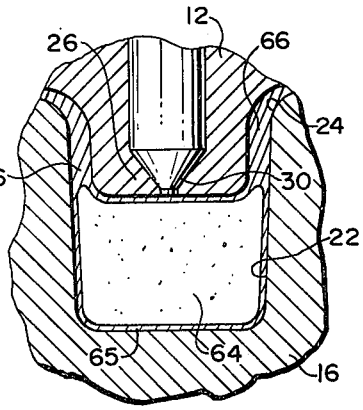

In FIG. 3C the body of steam shown at 64 has been to a large extent spent in driving the liquid 50 into the mold cavities. There are some small ends of metal at 66 in the channels 24. The steam remains in this partially spent pressure condition until the castings have solidified, and while still warm the die halves may be opened. The gate metal will be expressed when the die halves part making the die easier to clean after a cycle of operation. There may be an inner crust 65 formed on the interior of the well after the molten metal has been blown into the molds, but this is of no consequence.

Many of the advantages of the method and apparatus have been mentioned. In addition to these the time for chilling the casting is cut down, the size and expense of the casting machine is reduced and the machine itself may be made very simply. The structure for injecting the liquid into the well by way of the injector nose 26 with its built-in valve and port can be considerably varied. The nose itself is advantageous for forming gating channels and the like but in cases where it is solid, the vaporizable liquid may be injected at the bottom of the well or into one or more sides thereof. The die will be constructed accordingly. The well may be in structure that is an adjunct to the die for economy and other reasons.

The most practical and efficient way of achieving the benefits of the invention is to have the well described above provided directly in the die and to inject the vaporizable material directly into the well. There are substantial numbers of die casting machines representing capital investment that would be lost if a die caster would want to convert to using the method and apparatus of the invention by making completely new dies and machinery. It is feasible to have the well and injection means located elsewhere than in the die itself. Thus, such a structure could be remote from the actual die and connected thereto by suitable runners or conduits so that the initial vaporization and expansion takes place outside of the die but results in the molten metal being driven into the die and its molds. Existing dies and machines could be modified and rebuilt to accomplish this in order to salvage some of the investment therein. It is pointed out, however, that the further the source of molten metal from the die the greater the heat loss in the passage of such metal to the molds. This must be taken into consideration in designing a system and applying the method of the invention thereto.

Figure 4:
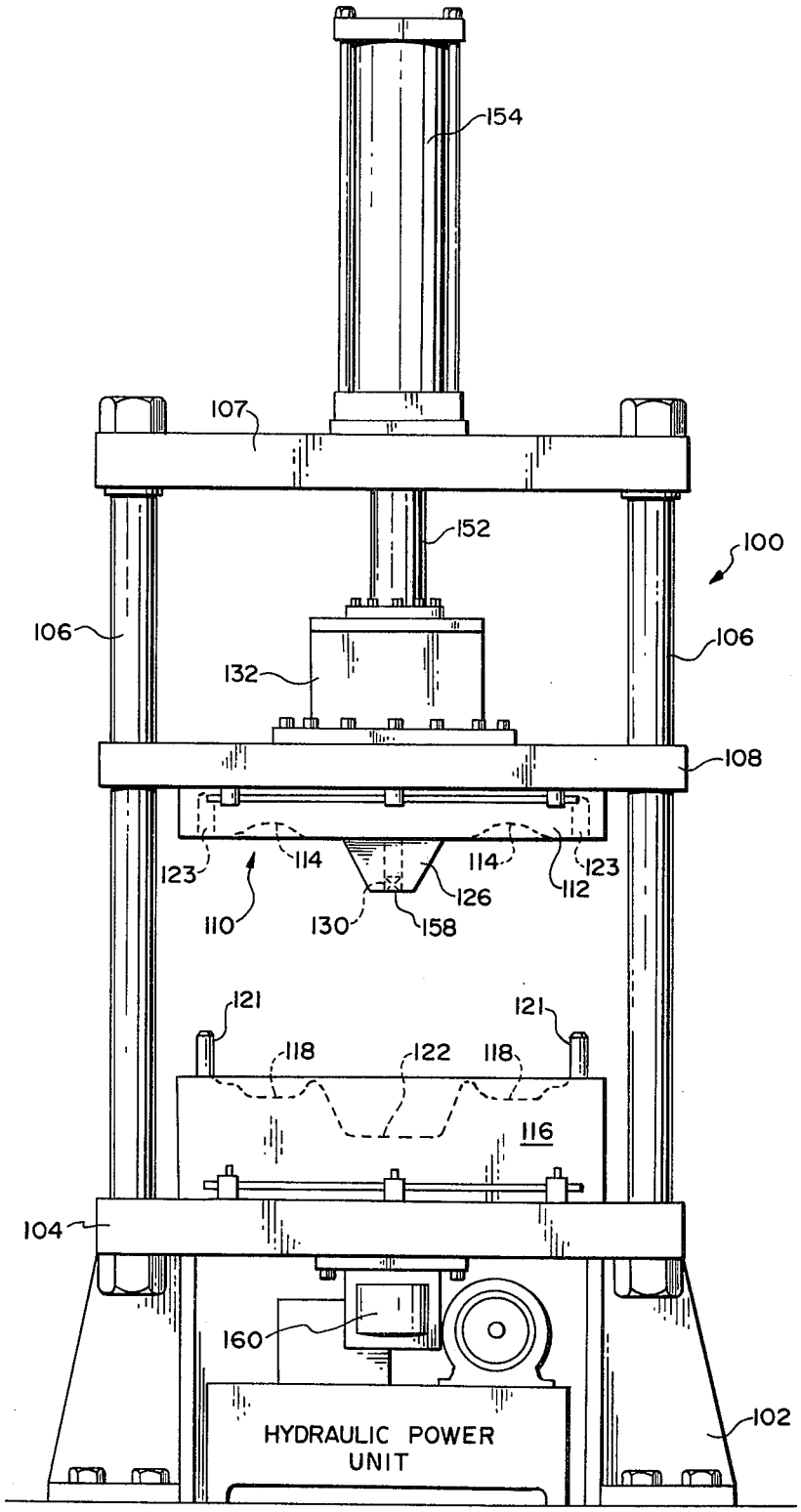
FIG. 4 is an elevational view more or less diagrammatic in nature illustrating a form of die casting machine suitable for use in carrying out the invention.

In FIG. 4 there is illustrated a practical example of a vertical die-casting machine which is readily constructed using the principles of the invention and for practicing the method thereof.

The machine is designated 100 and it has a base 102, die bed 104, vertical guide columns 106, a fixed top structural head member 107 and a movable crosshead 108. The die 110 has its two halves 112 and 116 mounted respectively to the underside of the movable crosshead 108 and the top of the die bed 104. The die halves have formations 114 and 118 which are to combine to form the castings when the die halves 112 and 116 are brought together. The well which was described previously is formed at 122 in the bottom die half 116 and the injector nose 126 is provided in the top die half 112. A liquid injector mechanism is shown at 132 mounted on the upper side of the movable crosshead 108. The valve 130 for injecting the liquid is in the nose 126 and the port therefrom opens at 158 down into the well 122 when the die halves are mated. Pines 121 cooperate with sockets 123 for piloting the die halves as they move together.

The movable crosshead 108 is raised and lowered as required by the driven piston 152 attached to the top of the water injection unit 132 and actuated by the hydraulic cylinder 154 that is mounted on top of the fixed crosshead 107.

The remainder of the apparatus 100 is a matter of design. For example, there can be a hydraulically operated casting ejector mechanism 160 secured below the die bed 104 and operating through the bed. None of the connections to electrical, hydraulic and mechanical controls is shown in FIG. 4, but obviously the practical apparatus will have the same. Power connections are also not shown in this simplified diagram.

The invention is applicable to the casting of all types of articles from a variety of metals. As a matter of fact, the method of the invention renders casting zinc objects easier than heretofore because the temperatures used are lower. Densities are greater because of such lower temperatures. Wall thicknesses can be less and shrinkage is less.

While die-casting is normally applied to the casting of multiple objects in a single cycle, a single object such as for example, an intricate part can be produced advantageously by this method. Thus, reference made in the claims to "mold means," etc., is intended to cover the production of one or a plurality of castings in a single die.

The speed of the conversion of the liquid into vapor may be decreased by using liquids which are maintained or capable of being maintained at a lower temperature than water without freezing. This may be achieved by using mixtures of water and chemicals such as common anti-freeze of the permanent type. For example, monoethyleneglycol would be suitable, especially since its boiling point is much higher than that of water. Under certain conditions, solids which pass into a vapor phase at the temperatures met may be used. This may include solids which sublime such as carbon dioxide and the like or solids which pass through a liquid phase first, such as ice. The practical tests of the invention utilized only water, but there seems to be no practical reason why other materials liquid or solid will not be usable. The criteria are related to the original temperature of the material when immersed into the molten metal, the requirements for converting the material into a vapor and the available heat from the particular quantity and type of molten metal being used. These data can be obtained and the quantities needed computed.

Injection or plunging of solids into molten metal can be achieved by mechanical means that can be devised by those skilled in the art.

The process and apparatus are capable of considerable variation without departing from the spirit or scope of the invention as defined in the appended claims.

What is claimed and desired to secure by Letters Patent of the United States is:

1. A method of die-casting which comprises

A. providing a well in association with a die which connects with the mold means of the die, B. introducing a predetermined quantity of molten metal into the well to form a body having sufficient volume to fill the mold means and at least a portion of the connection means between the well and the mold means, C. confining the well and mold means, D. injecting a predetermined volume of vaporizable material into the body of molten metal below the surface thereof having a volume which when vaporized by the heat of the body of metal will expand and produce sufficient pressure to drive the metal from well into the mold means, E. permitting the contents of said mold means to solidify and F. removing the resulting solidified contents from the die.

2. The method as claimed in claim 1 in which the material is a liquid.

3. The method as claimed in claim 2 in which the liquid is de-ionized water.

4. The method as claimed in claim 2 in which the liquid is cooled prior to injection to a degree which prevents vaporizing until after injection.

5. The method as claimed in claim 2 in which the liquid is injected from the top of the well and down into the well.

6. The method as claimed in claim 2 in which the pressure produced by the vaporizing of the liquid is permitted to remain in the well after the contents have solidified to assist in removal thereof.

7. The method as claimed in claim 1 in which the mold means comprise a plurality of molds arranged to provide a plurality of castings and the connection means comprise channels extending from the respective molds to said well, the amount of molten metal introduced into the well being sufficient to enter and partially fill the channels in addition to filling said molds under the pressure of vaporization.

8. Die-casting apparatus comprising:

A. a die set of upper and lower halves adapted to be mated together and having mold cavity means formed therein, B. means forming a well and including a movable covering structure therefor, C. connecting channel means extending from the well to the cavity means, D. at least the cavity means and part of the channel means being confined when the halves are brought together, the well forming means and covering structure also arranged to move together when said halves are brought together whereby such of said channel means not otherwise confined by engagement of said halves and the well are also fully confined, E. the capacity of the well being of a volume somewhat greater than the volume required fully to fill the cavity means, and F. said well forming means and covering structure having means for enabling a vaporizable material to be injected into the well while the cavity means, channel means and well are fully confined.

9. The die-casting apparatus as claimed in claim 8 in which said last-mentioned means are in the covering structure.

10. The die-casting apparatus as claimed in claim 8 in which the covering structure has an injector nose which is located such that it enters the well when the well forming means and covering structure are mated together and said channel means include portions alongside said nose.

11. The die-casting apparatus as claimed in claim 8 in which the well forming means and the covering structure comprise an integral part of the respective die halves such that the bringing together of the die halves simultaneously confines the well, channel means and cavity means.

12. The die-casting apparatus as claimed in claim 11 in which the upper half has an injector nose which is located such that it enters the well when the halves are mated together and said channel means include portions alongside said nose.

13. The die-casting apparatus as claimed in claim 11 in which the upper half has an injector nose which is located so that it enters the well when the halves are mated and the means for enabling liquid to be injected includes an injection port at the tip of the nose whereby in the event there is molten metal in the well, liquid may be injected below the surface of said molten metal.

14. The die-casting apparatus as claimed in claim 11 in which means are provided for moving the halves together in a vertical path for mating them.

15. The die-casting apparatus as claimed in claim 11 in which at least a portion of the means for enabling liquid to be injected in the well located in one of the halves and includes a valve and a port through which the liquid is adapted to emerge under the control of said valve, the port being located in the well when the halves are mated together.

16. The die-casting apparatus as claimed in claim 15 in which said one of said halves is the upper half.

17. The die-casting apparatus as claimed in claim 15 in which said portion is provided with cooling means to prevent vaporization of said liquid before emerging from said port.

18. The die-casting apparatus as claimed in claim 16 in which the upper half has a projection comprising a nose which enters said well when the halves are mated together and the port is at the tip of the nose.

19. The die-casting apparatus as claimed in claim 14 in which at least a portion of the means for enabling liquid to be injected in the well is located in the upper half and includes a valve and a port through which the liquid is adapted to emerge under the control of said valve, the upper half having a depending nose adapted to enter the well when the halves are moved together and the port being in the tip of the nose.

20. Die-casting apparatus comprising:

A. a frame having vertically arranged guide members,

B. a die bed on the frame arranged horizontally between the guide members adjacent the bottom ends thereof, C. a fixed crosshead at the top of the guide members, D. a movable crosshead arranged to slide vertically upon said guide members between the fixed crosshead and the die bed, E. means on the fixed crosshead for moving the movable crosshead up and down, F. a die set comprising an upper die half secured to the bottom of the movable crosshead and a lower die half secured to the top of the die bed, said die set comprising:

i. formations in the facing sides arranged to form mold means when the halves are brought together, ii. a well in the lower half, iii. channel means cooperating when the halves are brought together extending from the well to the mold means, iv. the mold means, well and channel means being fully contained within the die set when the halves are brought together, G. the movable crosshead adapted to move the halves together and secure them in such condition, and H. the movable crosshead and upper die half having means for injecting a vaporizable liquid into the well when said halves are secured together.

21. The apparatus as claimed in claim 20 in which said last mentioned means include a projection on the upper die half, a valve in the die half, a source of such liquid, a port in the projection tip and the valve being arranged to discharge liquid from the source through the port, the tip being disposed to enter the well when the die halves are secured together.

* * * * *